US005250495A

United States Patent [19]

Saito et al.

[11] Patent Number: 5,250,495

[45] Date of Patent: * Oct. 5, 1993

[54] HEAT TRANSFER RECORDING PROCESS

[75] Inventors: Hitoshi H. S. Saito; Masaki M. K. Kutsukake; Mineo M. Y. Yamauchi; Minoru M. F. Furuse, all of Tokyo, Japan

[73] Assignee: Dai Nippon Insatsu Kabushiki Kaisha, Japan

[ * ] Notice: The portion of the term of this patent subsequent to Jul. 14, 2009 has been disclaimed.

[21] Appl. No.: 876,414

[22] Filed: Apr. 30, 1992

Related U.S. Application Data

[63] Continuation of Ser. No. 480,718, Feb. 15, 1990, Pat. No. 5,130,293.

[30] Foreign Application Priority Data

Feb. 15, 1989 [JP] Japan ..... 1-33754

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

FOREIGN PATENT DOCUMENTS 0222374 5/1987 European Pat. Off. ..... 503/227
0245689 11/1987 European Pat. Off. ..... 503/227

OTHER PUBLICATIONS

Patent Abstracts of Japan, vol. 12, No. 41 (M-666)(2888) Feb. 6, 1988 & JP-A-62 193889 (Teijin Limited) Aug. 26, 1987, the whole document.

Patent Abstracts of Japan, vol. 11, No. 310 (M-630)(2757) Oct. 9, 1987 & JP-A-62 95289 (Teijin Limited) May 1, 1987, the whole document.

*Primary Examiner*—B. Hamilton Hess
*Attorney, Agent, or Firm*—Parkhurst, Wendel & Rossi

[57] ABSTRACT

A heat transfer recording process which performs dotwise printing by means of a dotwise heating means. The process includes the use of a heat transfer sheet comprising a lubricating layer provided on one surface of a substrate film and a dye layer provided on the other surface of the substrate film, and an image-receiving sheet comprising a substrate film and an image-receiving layer formed thereon. The dynamic frictional coefficient at nonprinting between the dye layer of the heat transfer sheet and the image-receiving surface of the image-receiving sheet is within the range of 0.1–0.6.

12 Claims, No Drawings

HEAT TRANSFER RECORDING PROCESS

This is a Rule 60 continuation application of parent application Ser. No. 07/480,718 filed Feb. 15, 1990, now U.S. Pat. No. 5,130,293.

BACKGROUND OF THE INVENTION

This invention relates to a heat transfer sheet which uses a sublimable dye (heat migratable dye), more particularly, to a heat transfer sheet which has solved problems of printing wrinkle and image dislocation due to slippage generated during heat transfer printing.

Various heat transfer methods have been known in the art, and among them, there has been proposed a method in which a sublimable dye is used as the recording material. The dye is carried on a substrate sheet such as a polyester film to form a heat transfer sheet. By using the transfer sheet, various full colors are formed on an image-receiving sheet having a dye receptive layer with a sublimable dye formed on a substrate such as paper or plastic film. In this case, a thermal head of a printer is used as the heating means, and a large number of color dots of 3 or 4 colors are transferred onto the image-receiving sheet by heating for a very short time, thereby reproducing the full-color image of the original with the multi-colored color dots.

The thus formed image is very sharp, since the colorant used is a dye and also excellent in transparency, whereby the obtained image is excellent in reproducibility and gradation of the intermediate color, similar to the image according to the offset printing and gravure printing of the prior art, and further can form an image of high quality comparable with full-color photographic images.

As the substrate film of the above heat transfer sheet, papers such as condenser paper may be sometimes employed, but such thin paper is lower in strength, particularly weak in bursting strength and therefore, it is desirable to use a film having a tough plastic nature such as polyester resin as the substrate film.

However, in this case, the following problems will further ensue. That is, the transfer sheet is thermally deformed due to the heat of a temperature of 250° to 300° C. or higher being locally loaded from the thermal head to the heat transfer sheet during printing. Further, the heat transfer sheet is conveyed under pressurization of a thermal head and is nonuniformly elongated, whereby a large number of wrinkles are generated on the sheet. As a result, not only running under the thermal head is obstructed, but also slippage and drop-out of the dots are generated in the obtained image, thus involving the problem that the resolution of the printed image is lowered, and also that color reproducibility is lowered in formation of full-color. Such problems become particularly conspicuous when a marked density difference is needed for the image to be formed, because the heat content imparted to the thermal head has a locally great difference.

The problems as mentioned above can be alleviated by use of a substrate having a relatively greater thickness, but in this case, sensitivity of the heat transfer sheet is lowered to become practically useless.

In another method, it has been proposed to provide a heat-resistant protective layer such as a thermosetting resin on the surface opposite to the dye layer. However, even by use of these methods, if the heat-resistant protective layer is made thick to the extent effective for prevention of printing wrinkle phenomenon, sensitivity of the heat transfer sheet and resolution of the printed image are lowered, and therefore they cannot be satisfactory measures of solution.

Accordingly, an object of the present invention is to provide a heat transfer sheet capable of giving the image which is excellent in sharpness and resolution and has sufficient printing density without causing printing wrinkles and image slippage.

SUMMARY OF THE INVENTION

The above objects can be accomplished by the present invention as specified below.

More specifically, the present invention is a heat transfer sheet comprising a lubricating layer provided on one surface of a substrate film and a dye layer formed on the other surface of the substrate film, wherein the elastic modulus in at least one of the sub-scanning direction (MD) and the main scanning direction (TD) in said heat transfer sheet is 280 kg/mm$^2$ or more, and the elastic modulus ratio MD/TD in the sub-scanning direction (MD) and the main scanning direction (TD) is within the range of from 0.8 to 1.3.

The second embodiment of the present invention is a heat transfer sheet comprising a lubricating layer provided on one surface of a substrate film and a dye layer formed on the other surface of the substrate, wherein the dynamic frictional coefficient between said lubricating layer and the thermal head is within the range of from 0.07 to 0.16.

The third embodiment of the present invention is a heat transfer sheet comprising a lubricating layer provided on one surface of a substrate film and a dye layer formed on the other surface of the substrate, wherein the dynamic frictional coefficient at nonprinting ($\mu_0$) between the dye layer and the surface of a material to be heat transferred is within the range of from 0.1 to 0.6.

By making the elastic modulus in at least one of the sub-scanning direction (MD) and the main scanning direction (TD) of the heat transfer sheet 280 kg/mm$^2$ or more, and the elastic modulus ratio MD/TD within the range of from 0.8 to 1.3, or by making the dynamic the thermal head 0.07 to 0.16, or by making the dynamic frictional coefficient at non-printing ($\mu_0$) between the dye layer and the surface of an image-receiving sheet 0.1 to 0.6, no fine wrinkle or no image slippage occurs in the heat transfer sheet during printing, whereby an image with excellent resolution and color reproducibility can be formed.

DETAILED DESCRIPTION OF THE INVENTION

Referring now to preferred embodiments, the present invention is described in more detail.

As the substrate film to be used in the heat transfer sheet of the present invention, polyester films such as polyethylene terephthalate film, polyethylene naphthalene dicarboxylate film, etc. are particularly preferred, but otherwise, other plastic films such as polystyrene film, polypropylene film, polysulfone film, polycarbonate film, Aramide film, or polyether ether ketone film preferably may be used. Of course, in these films, any desired additive such as extender pigment, UV-ray absorber, antioxidant, or stabilizer may be contained. Also, an easily adherable film previously applied with easy adhesion treatment on one surface or both surfaces of the film may be used. Also, the above-mentioned film should be preferably stretched by use of a general method into a biaxially oriented film, but a substrate film strongly in either one direction of the MD direction or the TD direction is not desirable.

If the thickness of the film is too thin, heat resistance is deficient, while if it is too thick, migration efficiency of dye is lowered. Therefore, its preferable thickness may be 0.5 to 50 μm, particularly 1 to 20 μm, and the shape may be a film shaped in sheet cut into predetermined dimensions, or a continuous or wind-up film, or further a tape-like film with a narrow width.

The above-mentioned substrate film, when the adhesive force with the dye layer formed on its surface is poor, should be preferably applied with the primer treatment or the corona discharging treatment.

The sublimable (heat migratable) dye layer to be formed on the substrate film as mentioned above is a layer having a dye carried with any desired resin.

As the dye to be used, all of the dyes used in the heat transfer sheets known in the art are effective available for the present invention, and not particularly limited. For example, some preferable dyes may include, as red dyes, MS Red G, Macrolex Red Violet R, Ceres Red 7B, Samaron Red HBSL, SK Rubin SEGL, Baymicron SN VP 2670, Resoline Red F3Bs, etc.; as yellow dyes, Foron Brilliant Yellow S-6GL, PTY-52, Macrolex Yellow 6G, Terasil Golden Yellow-2RS, etc.; as blue dyes Kayaset Blue 714, Waxoline Blue AP-FW, Foron Brilliant Blue S-R, MS Blue-100, Daito Blue No. 1, etc.

As the binder resin for carrying the heat migratable dye as mentioned above, any of those known in the art can be used, and preferable examples may include cellulose resins such as ethyl cellulose, hydroxyethyl cellulose, ethylhydroxy cellulose, hydroxypropyl cellulose, methyl cellulose, cellulose acetate, cellulose acetate butyrate, etc., vinyl resins such as polyvinyl alcohol, polyvinyl acetate, polyvinyl butyral, polyvinyl acetoacetal, polyvinyl pyrrolidone, polyacrylamide, etc., polyesters and others, and among them, cellulose type, acetal type, butyral type and polyester type are particularly preferred.

The dye layer is formed along each predetermined pattern by selecting any desired one color from among the above-mentioned dyes when the image to be formed is a mono-color, while it is formed in any desired combination of those of predetermined hues selected from among appropriate cyan, magenta, yellow, black, etc. when the image to be formed is a multi-color image.

The dye layer of the heat transfer sheet of the present invention is formed basically of the materials as described above, but otherwise can also include various similar additives known in the art, if necessary.

Such dye layer is preferably prepared by adding the above-mentioned sublimable dye, binder resin and other optional components to dissolve or disperse the respective components to prepare a coating material or an ink for formation of dye layer, and coating and drying this on the substrate film as described above.

The dye layer thus formed has a thickness of about 0.2 to 5.0 μm, preferably 0.4 to 2.0 μm, and the sublimable dye in the dye layer should suitably exist in an amount of 5 to 90% by weight, preferably 10 to 70% by weight, of the weight of the dye layer.

Also, in the present invention, a primer layer also may be provided between the substrate film and the dye layer, if necessary. The primer layer is provided for improvement of adhesion between the substrate film and the dye layer, protection of the substrate film, etc. For example, when a hydrophilic resin is used as the primer layer, it plays a role of the barrier layer which prevents migration of the dye from the dye layer to the substrate film. As the material for forming the primer layer, there may be used effectively those materials having smaller diffusion coefficients of the dye in the dye layer, such as polyester resins, polyurethane resins, acrylic polyol resins, vinyl chloride-vinyl acetate copolymer resins, cellulose resins such as cellulose acetate, methyl cellulose, etc., polyvinyl alcohol, gelatin, etc.

In the present invention, it is preferable to improve the lubricating characteristic between the thermal head and the substrate film by providing a lubricating layer on the surface of the substrate opposite to the dye layer. As the material for forming such lubricating layer, phosphoric acid ester, silicone oil, graphite powder, etc. may be included.

Also, it is preferable to impart heat resistance to the above-mentioned lubricating layer. As the heat-resistant lubricating layer, those known in the art may be available, including polyvinyl butyral resin, polyvinyl acetoacetal resin, polyester resin, vinyl chloride/vinyl acetate copolymer, polyether resin, polybutadiene resin, styrene/butadiene copolymer, acrylic polyol, polyurethane acrylate, polyester acrylate, polyether acrylate, epoxy acrylate, prepolymer of urethane or epoxy, nitrocellulose resin, cellulose nitrate resin, cellulose acetopropionate resin, cellulose acetate propionate resin, cellulose acetate butyrate resin, cellulose acetate hydrogen phthalate resin, cellulose acetate resin, aromatic polyamide resin, polyimide resin, polycarbonate resin, chlorinated polyolefin resin, etc. As the lubricity imparting agent to be added to or coated on these heat-resistant layers, there may be included phosphoric acid ester, silicone oil, graphite powder, silicon type graft polymer, fluorine type graft polymer, acrylic silicon graft polymer, silicone polymers such as acrylic siloxane, aryl siloxane, etc., but preferably a layer comprising a polyol, such as a polyalcohol polymeric compound, a polyisocyanate compound and a phosphoric acid ester type compound, and further it is more preferable to add a filler.

Such polyalcohol polymeric compound should be desirably selected from among polyvinyl butyral resin having hydroxyl group, polyester resin, vinyl chloride/vinyl acetate copolymer, polyether resin, polybutadiene resin, acrylic polyol, prepolymer of urethane or epoxy, or nitrocellulose resin, cellulose acetate propionate resin, cellulose acetate butyrate resin or cellulose acetate resin, etc.

The above resin may be, in addition to those having hydroxyl groups in their polymer units, also those having unreacted hydroxyl groups at the terminal ends or in the side chains. A particularly suitable polyalcohol polymer compound is a polyvinyl butyral resin which forms a reaction product excellent in heat resistance. As the polyvinyl butyral resin, one having a high molecular weight and also containing many hydrox groups which are the reaction sites with polyisocyanates is preferred. Particularly preferred of the polyvinyl butyral resin are those having a molecular weight of 60,000 to 200,000, a glass transition temperature of 60° to 110° C., and a content of the vinyl alcohol moiety of 15 to 40% by weight.

As the polyisocyanates to be used during formation of the above-mentioned heat-resistant lubricating layer, polyisocyanates such as diisocyanates, triisocyanates, etc. may be included and these may be used single or as a mixture. Specifically, there may be included:
p-phenylene diisocyanate,
1-chloro-2,4-phenyldiisocyanate,
2-chloro-1,4-phenyldiisocyanate,
2,4-toluene diisocyanate,
2,6-toluene diisocyanate,
hexamethylene diisocyanate,
4,4'-biphenylene diisocyanate,
triphenylmethane triisocyanate,
4,4',4''-trimethyl-3,3',2'-triisocyanate,
2,4,6-triphenylcyanurate, etc.

The isocyanates may be used relative to the polyalcohol polymer compound in amounts generally of 1 to 400 parts by weight, preferably 5 to 300 parts by weight, based on 100 parts by weight of the polyalcohol polymer compound.

The phosphoric acid ester type compound imparts lubricity to the heat-resistant layer, and specifically, GAFAC RD720 manufactured by Toho Kagaku, Japan, Plysurf A-208S manufactured by Daiichi Kogyo Seiyaku, Japan, may be employed. Such phosphoric acid ester type compound may be used at a ratio of 1 to 150 parts by weight, preferably 5 to 100 parts by weight, per 100 parts by weight of the polyalcohol polymer compound.

As the filler to be added in the heat-resistant lubricating layer, there may be included inorganic fillers or organic fillers having heat resistance such as clay, talc, zeolite, aluminosilicate, calcium carbonate, Teflon powder, lead oxide, titanium oxide, magnesium oxide, silica, carbon, condensates of benzoguanamine and formaldehyde, etc.

The mean grain size of such fill may be 3 μm or less, desirably 0.1 to 2 μm. The filler may be used in an amount of 5 to 60% by weight, preferably 10 to 40% by weight, based on the polyalcohol polymer compound.

By use of such filler in the heat-resistant lubricating layer, there is no fusion between the thermal head and the heat transfer sheet, whereby the so called sticking phenomenon will not be recognized at all.

The heat-resistant lubricating layer may have a film thickness of 0.05 to 5 μm, preferably 1 to 2 μm. If the film thickness is thinner than 0.05 Pm, the effect as the heat-resistant lubricating layer is not sufficient, while if it is thicker than 5 μm, the heat transmission from the thermal head to the dye layer becomes poorer, whereby there ensues the drawback that printing density is lowered.

The heat transfer sheet in the present invention may also have an adhesion improving layer between the heat-resistant lubricating layer and the substrate film.

As the adhesion improving layer, one which can consolidate the adhesion between the substrate film and the heat-resistant lubricating layer may be employed, as exemplified by polyester type resin, polyurethane type resin, acrylic polyol type resin, vinyl chloride-vinyl acetate copolymer type resin, etc., which may be used either singly or in a mixture by coating. Also, if necessary, a reactive curing agent such as polyisocyanate, etc. may be added. Further, a titanate and silane type coupling agent may be used. Also, if necessary, two or more layers may be laminated.

The heat transfer sheet in the present invention may also substantially contain an antistatic agent, and as the antistatic agent, there can be employed cationic type surfactants (e.g. quaternary ammonium salt, polyamine derivative, etc.), anionic type surfactants (e.g. alkyl phosphate, etc.), amphoteric type surfactants (e.g. those of the betaine type, etc.) or nonionic surfactants (e.g. fatty acid ester, etc.), and further those of the polysiloxane type.

The heat transfer sheet of the first embodiment, in such a constitution as described above, is characterized by making the modulus in at least one of the sub-scanning direction (MD) and the main scanning direction (TD) in the heat transfer sheet 280 kg/mm$^2$ or more, and, the modulus ratio MD/TD within the range of from 0.8 to 1.3.

If the modulus of either one of MD and TD is less than kg/mm$^2$, or the modulus ratio MD/TD is outside the above range, fine wrinkles will be generated during heat transfer, whereby the objects of the present invention cannot be accomplished. Further preferable modulus in the MD or TD direction is 300 kg/mm$^2$ or more, and further preferable modulus ratio of MD/TD is in the range of from 0.9 to 1.1, and in this case, it is more preferable that the strength balance should be better in both the MD and TD direction.

The heat transfer sheet having the modulus characteristics as described above can be obtained by taking care about the preparation conditions in the preparation steps, such as drying, etc. of the above heat transfer sheet so that the time residing at a high temperature of 100° C. or higher may be suppressed within 90 seconds at the maximum, desirably within 60 seconds.

The modulus in the present invention does not concern the substrate film alone, but in the state of the completed heat transfer sheet, and its measurement was conducted for a sample strip of 50 mm×15 mm under the conditions of normal temperature and normal pressure by means of Tensilon (UCT-100, Orientech K.K.). Measurement was conducted under the conditions of an initial gauge length of 33 mm, a drawing speed of 50 mm/min., and within the range where the sample exhibits elastic deformation, elongation was measured for every certain load (every 50 g from 250 g to 750 g of weight), the slope was determined from the load difference and the elongation difference, and the modulus was determined by linearization according to the method of least squares.

Also, in a preferred embodiment of the present invention, by controlling the heating shrinkage in the MD and TD direction of the heat transfer sheet (150° C. and 30 minutes) within the range of 0 to 2.5%, further excellent wrinkle generation prevention effect can be obtained.

The heat transfer sheet having the above thermal characteristics can be obtained by taking care about the preparation conditions in the preparation steps, such as drying, etc. of the above heat transfer sheet so that the time residing at a high temperature of 100° C. or higher may be suppressed within 90 seconds at the maximum, desirably within 60 seconds.

It should be noted that the heating shrinkage in the present invention does not concern the substrate film itself, but it is a value measured under the state of the completed heat transfer sheet.

Also, in the second embodiment of the present invention, by making the dynamic frictional coefficient between the lubricating layer provided on the back of the heat transfer sheet and the thermal head within the range of from 0.07 to 0.16, more preferably from 0.09 to 0.13, further wrinkle prevention effect can be achieved. At a value higher than this range, under practical printing pressure conditions, due to great friction between the thermal head the back layer surface generation of wrinkles is extremely liable to occur. Also, also with a value lower than this range, from the influence of the stress from the platen roll, the tension of film, etc., delicate slippage of the printing position is liable to occur between the thermal head and the back layer surface. Consequently, such problems as distortion of the printed image, or in the case of a full-color image, positional slippage between the respective colors, etc. will occur.

The heat transfer sheet having the above frictional characteristics can be obtained by maintaining the amount of the lubricity imparting agent added during preparation of the above heat transfer sheet at an adequate value.

In the third embodiment of the present invention, controlling the dynamic frictional coefficient at non-printing between the dye layer and the surface of an image-receiving sheet within 0.1 to 0.6, wrinkle generation can be prevented effectively.

Further, according to preferred embodiment of the present invention, by maintaining the dynamic frictional coefficients between the dye layers and the image-receiving layer surface, namely the dynamic frictional coefficient between a first color dye layer and the image-receiving surface of the transferable material during non-printing ($\mu_0$) within the range of 0.1 to 0.6, the dynamic frictional coefficient between the above image-receiving surface after solid printing of the above first color and a second color dye layer ($\mu_1$) within the range from 0.3 to 1.0, and the dynamic frictional coefficient between the image receiving surface having solid printing effected overlappingly on the solid printing of the above first color and a third color dye layer ($\mu_2$) within the range from 0.6 to 1.5, further excellent wrinkle generation prevention effect can be obtained.

Over these ranges, particularly when the density of the image formed has a great difference in the MD direction, wrinkles caused by flexing of the transfer film are liable to be formed on its boundary line. This phenomenon may be considered to be caused by the different peeling force of the dye layer surface and the image-receiving paper during printing depending on the heat content applied by the thermal head, whereby the distortion of the transfer film formed at the image portion with great density difference if the lubricating characteristic is enough cannot be released. On the other hand, below these ranges, from the influence of the stress of the platen roll, the tension of the film, delicate slippage of the printing position is liable to occur between the transfer sheet and the image-receiving sheet, in the case of distortion of printed image or full-color image, the problem of positional slippage between the respective colors, etc. will be caused to occur.

The dye layer having such desirable frictional coefficients can be realized by such methods as adding into the dye layer an organic filler such as hydrocarbon type, polyolefin type, fluorine resin type, silicon resin type, etc., inorganic filler such as titanium oxide, silicon oxide, calcium carbonate, etc., silicone oil, silicone type, fluorine type graft polymer, coating silicone oil on the dye layer surface, or using a resin of silicone type, fluorine type as a part or all of the binder resin in the dye layer. The mean particle size when employing an organic filler or an inorganic filler may be 50 $\mu$m or less, preferably 10 $\mu$m or less, more preferably 5 $\mu$m.

For the measurement method of frictional method, there are methods as standardized by ASTM (e.g., ASTM D1894), but because the dynamic frictional coefficient influencing wrinkle generation could not be measured, the value measured according to the following method is made as the standard in the present invention.

A sample strip with 150 mm width in the MD direction and 100 mm width in the TD direction is prepared, an image-receiving sheet for exclusive use is arranged on the platen roll of a printer with the image-receiving layer on the outside, the above sample strip is arranged thereon with its back upside, a thermal head (KMT-85-6MPD2, Kyocera K.K., Japan) is arranged thereon, a load of 2 kg is applied on said head, the image-receiving sheet is drawn at a drawing speed of 500 mm/min. by means of Tensilon (UCT-100, Orientech K.K.) under the conditions of normal temperature and normal pressure, and the value is determined from the following formula:

$$\mu=(F-R)/2{,}000$$

(where R is rotation resistance of platen roll).

When determining the dynamic frictional coefficients between the dye layer and the image-receiving layer ($\mu_0$, $\mu_1$, $\mu_2$), measurement was conducted with the rear end of the transfer sheet being fixed, and when determining the dynamic frictional coefficient between the thermal head and the back layer, without fixing.

Dense solid printing during measurements of $\mu_1$ and $\mu_2$ was performed by means of a test printer under the following conditions.

Thermal head: KMT-85-6MPD2, Kyocera K.K.
Application voltage: 11.0 (V)
Delivery speed: 33.3 msec./line
Pulse width: 16.0 msec.
Printing temperature: 40° C.

The image-receiving sheet to be used for forming an image by use of the heat-transfer sheet as described above may be any one of which recording surface has dye receptivity for the dye as mentioned above, and in the case of paper, metal, glass, synthetic resin film or sheet, etc. having no dye receptivity, the dye receptive layer may be formed on at least one surface thereof from a resin excellent in dye receptivity. Also, in such dye receptive layer, it is preferable to incorporate as the release agent a solid wax such as polyethylene wax, amide wax, Teflon powder, etc., a fluorine type, phosphoric acid ester type surfactant, a silicone oil, etc. known in the art.

For the means for imparting heat energy during heat transfer to be used in the present invention, any of the imparting means known in the art can be used. For example, by means of a recording device such as a thermal printer (e.g. Video Printer VY-100, Hitachi Seisakusho K.K.), etc. the desired objects can be fully accomplished by controlling the recording time to impart a heat energy of about 5 to 100 mJ/mm$^2$.

According to the present invention as described above, by making at least one modulus in the sub-scanning direction (MD) and the main scanning direction (TD) of the heat transfer sheet comprising a dye layer formed on the surface of a substrate film having a lubricating layer on the back 280 kg/mm$^2$ or higher, and also the modulus ratio of MD/TD within the range from 0.8 to 1.3, no Wrinkle or image slippage is generated during printing, whereby it becomes possible to form an image excellent in resolution and color reproducibility.

Referring now to Examples and Comparative examples, the present invention is described in more detail. In the sentences, parts or % are based on parts by weight, unless otherwise particularly noted.

EXAMPLE A-1

On one surface of a polyethylene terephthalate film with a thickness of 4.5 μm (5AF53, Toray) was provided a polyester type subbing layer, and on its surface was coated an ink composition for formation of heat-resistant lubricating layer by a gravure coater, followed by drying under the conditions of a drying temperature of 100° to 110° C., a residence time in the drying hood of 10 seconds.

| Ink composition: | |
|---|---|
| Polyvinyl butyral resin (Ethlec BX-1) | 2.2 parts |
| Toluene | 35.4 parts |
| Methyl ethyl ketone | 53.0 parts |
| Isocyanate (Barnock D-750, Dainippon Ink Kagaku) | 6.8 parts |
| Phosphoric acid ester (Plysurf A-208S) | 1.6 parts |
| Phosphoric acid ester sodium salt (Gafac RD720, Toho Kagaku Kogyo) | 0.6 part |
| Talc (Microace L-1, Nippon Talc) | 0.4 part |
| Amine type catalyst (Desmorapid PP, Sumito Bayern Urethane) | 0.02 part |

The above film was subjected to the curing treatment by heating in an oven at 60° C. for 3 days. The amount of the ink coated after drying was found to be about 1.2 g/m$^2$.

Next, on the surface of the above film opposite to the heat-resistant lubricating layer, a polyester type subbing layer was provided, and an ink composition for formation of dye layer having the composition shown below was coated by a gravure coater to a dry coated amount of 1.2 g/m$^2$ thereon, followed by drying under the conditions of a drying temperature of 100° to 110° C. and a residence time in the drying hood of 30 seconds, to form a dye layer.

| Yellow ink: | |
|---|---|
| Foron Brilliant Yellow S-6GL (Sandoz) | 2.7 parts |
| Polyvinyl acetal resin (Sekisui Kagaku) | 3.3 parts |
| Polyvinyl butyral resin (Ethlec BX-1, Sekisui Kagaku) | 2.7 parts |
| Methyl ethyl ketone | 45.65 parts |
| Toluene | 45.65 parts |
| Magenta ink: | |
| MS RED G (Disperse Red 60, Mitsui Toatsu) | 2.4 parts |
| Microlex Red Violet R (Disperse Violet 26, Bayer) | 1.29 parts |
| Polyvinyl acetal resin (Sekisui Kagaku) | 3.85 parts |
| Hydrocarbon type wax (Microfine MF-8F, Dura) | 0.11 part |
| Methyl ethyl ketone | 46.22 parts |

-continued

| | |
|---|---|
| Toluene | 46.22 parts |
| Cyan ink: | |
| Kayaset Blue 714 (Solvent Blue 63, Nippon Kayaku) | 4.55 parts |
| Polyvinyl acetal resin (Sekisui Kagaku) | 3.85 parts |
| Hydrocarbon type wax (Microfine MF-8F, Dura) | 0.12 part |
| Methyl ethyl ketone | 45.8 parts |
| Toluene | 45.8 parts |

EXAMPLE A-2

A heat transfer sheet was obtained in the same manner as in Example A-1 except for changing the drying conditions after coating of the back heat-resistant lubricating layer to a drying temperature of 100° to 110° C. and a residence time in the drying hood to 40 seconds.

EXAMPLE A-3

A heat transfer sheet was obtained in the same manner as in Example A-1 except for using a polyethylene terephthalate film with thickness of 6 μm (6CF53, Toray) as the substrate film.

COMPARATIVE EXAMPLE A-1

A heat transfer sheet was obtained in the same manner as in Example A-1 except for changing the drying conditions after coating of the heat-resistant lubricating layer to a drying temperature of 140° C. and a residence time in the drying hood of 120 seconds.

COMPARATIVE EXAMPLE A-2

A heat transfer sheet was obtained in the same manner as in Example A-3 except for using a polyethylene terephthalate film of 6 μm having a stretching degree in the MD direction increased to great extent as the substrate film.

COMPARATIVE EXAMPLE A-3

A heat transfer sheet was obtained in the same manner as in Example A-3 except for using a polyethylene terephthalate film of 6 μm having a stretching degree in the TD direction increased to great extent as the substrate film.

TABLE 1

| | Example A | | | Comparative Example A | | |
|---|---|---|---|---|---|---|
| Physical property value | 1 | 2 | 3 | 1 | 2 | 3 |
| Substrate thickness (μm) | 4.5 | 4.5 | 6.0 | 4.5 | 6.0 | 6.0 |
| Modulus (kg/mm$^2$) | | | | | | |
| MD | 320.6 | 313.2 | 311.4 | 357.5 | 433.6 | 272.4 |
| TD | 301.7 | 290.8 | 346.9 | 263.8 | 251.5 | 349.2 |
| MD/TD | 1.06 | 1.08 | 0.9 | 1.36 | 1.72 | 0.78 |
| Heat shrinkage (%) | | | | | | |
| MD | 2.2 | 1.0 | 1.3 | 2.7 | 5.0 | 1.2 |
| TD | 1.0 | 0.0 | 0.3 | −0.2 | 2.5 | 0.0 |

EXAMPLE B-1

A heat transfer sheet was obtained according to the same manner as in Example A-1.

EXAMPLE B-2

A heat transfer sheet was obtained in the same manner as in Example A-2 except for changing the drying conditions after coating of the back heat-resistant lubricating layer to a drying temperature of 100° to 110° C. and a residence time in the drying hood to 40 seconds.

EXAMPLE B-3

A heat transfer sheet was obtained in the same manner as in Example A-3 except for using a polyethylene terephthalate film with a thickness of 6 μm (6CF53, Toray) as the substrate film.

COMPARATIVE EXAMPLE B-1

A heat transfer sheet was obtained in the same manner as in Example A-1 except for using a polyethylene terephthalate film 4.5 μm having a stretching degree in the MD direction increased to great extent as the substrate film.. In this case, a lubricating layer was formed by coating a methyl ethyl ketone solution of a phosphoric acid ester (Plysurf A-208S, manufactured by Daiichi Kogyo Seiyaku K.K., Japan) and drying.

COMPARATIVE EXAMPLE B-2

A heat transfer sheet was obtained in the same manner as in Example A-3 except for using a polyethylene terephthalate film of 6 μm having a stretching degree in the TD direction increased to great extent as the substrate film and using a following ink composition as a heat-resistance lubricating layer.

| Ink composition: | |
|---|---|
| Polyvinyl butyral resin (Ethlec BX-1, Sekisui Kagaku, Japan) | 4.5 parts |
| Toluene | 45 parts |
| Methyl ethyl ketone | 45.5 parts |
| Phosphoric acid ester (Plysurf A-208S, Daiichi Kogyo Seiyaku, Japan) | 0.2 part |
| Diisocyanate "Takenate D-110N" 75% ethyl acetate solution | 2 parts |

The dynamic frictional coefficient between the lubricating layer and the thermal head of the obtained heat transfer sheets were as follows.

TABLE 2

| Physical property value | Example-B 1 | Example-B 2 | Example-B 3 | Comparative Example-B 1 | Comparative Example-B 2 |
|---|---|---|---|---|---|
| Substrate thickness (μm) | 4.5 | 4.5 | 6.0 | 4.5 | 6.0 |
| Frictional coefficient | 0.10 | 0.09 | 0.11 | 0.06 | 0.17 |

REFERENCE EXAMPLE 1

On one surface of a synthetic paper (Yupo-FRG-150, Thickness 150 μm, Oji-Yuka) was coated by a bar coater and dried a coating solution having the composition shown below at a ratio to 10.0 g/m$^2$ on drying to obtain a heat transfer image-receiving sheet.

| Coating ink composition: | |
|---|---|
| Polyester (Vylon 600, Toyobo) | 11.5 parts |
| Vinyl chloride/vinyl acetate copolymer (VYHH, UCC) | 5.0 parts |
| Amino-modified silicone (KF-393, Shinetsu Kagaku) | 1.2 parts |
| Epoxy-modified silicone (X-22-343, Shinetsu Kagaku) | 1.2 parts |
| Methyl ethyl ketone/toluene/cyclohexanone (weight ratio 4:4:2) | 102.0 parts |

Each of the heat transfer sheets of Examples and Comparative Examples as described above was mounted on a video printer UP-5000 (Sony K.K., Japan) and dense solid printing of YMC was performed on the image-receiving sheet of Reference Example 1 to obtain the results shown below in Table 3.

TABLE 3

| | |
|---|---|
| Example A-1, B-1 | No generation of wrinkle by thermal head recognized at all, but clear dye image excellent in resolution and color reproducibility without slippage or drop-off of dot obtained. |
| Example A-2, B-2 | No generation of wrinkle by thermal head recognized at all, but clear dye image excellent in resolution and color reproducibility without slippage or drop-off of dot obtained. |
| Example A-3, B-3 | No generation of wrinkle by thermal head recognized at all, but clear dye image excellent in resolution and color reproducibility without slippage or drop-off of dot obtained. |
| Comparative Example B-1 | During printing, positional slippage of YMC 3 colors occurred, and normal image could not be obtained. |
| Comparative Examples A-1~3, B-2 | During printing, wrinkles formed on the film by heat of thermal head, and color drop-off occurred in the obtained image. |

EXAMPLE C-1

A heat transfer sheet was obtained in the same manner as in Example A-1 except for using a polyethylene wax (Microfine MF-8F) as an additional component of three dye in Example A-1. The thickness of the dye layer was 0.5 to 2.0 μm. The relationship between the dynamic frictional coefficient ($\mu_0$, $\mu_1$, $\mu_2$) and the printing property was evaluated. In the following evaluations, the image quality obtained by printing a real image with great density difference in the sub-scanning direction on the image-receiving sheet of Reference Example 1 by means of a video printer VY-25 (Hitachi Seisakusho K.K., Japan).

In this case, the ink composition of dyes $Y_1$ to $Y_{12}$, $M_1$ to $M_{12}$, and $C_1$ to $C_{12}$ were the same to each other except for the content shown in the table. The amount of the additive are based on the total weight of ink composition.

TABLE 4

| Dye Layer Ink | Content of MF8F (%) | $\mu_0$ | $\mu_1$ | $\mu_2$ | Printing property I | Printing property II |
|---|---|---|---|---|---|---|
| $Y_1$ | 0.00 | 0.42 | 0.72 | 1.15 | ◎ | ○ |
| $M_1$ | 0.07 | 0.30 | | | | |
| $C_1$ | 0.08 | 0.23 | | | | |
| $Y_2$ | 0.00 | 0.43 | 0.70 | 0.88 | ◎ | ○ |
| $M_2$ | 0.11 | 0.26 | | | | |
| $C_2$ | 0.12 | 0.25 | | | | |
| $Y_3$ | 0.00 | 0.42 | 0.60 | 0.72 | ◎ | ○ |
| $M_3$ | 0.15 | 0.24 | | | | |
| $C_3$ | 0.17 | 0.22 | | | | |
| $Y_4$ | 0.00 | 0.42 | 1.50 | 1.50 | ○ | ○ |
| $M_4$ | 0.00 | 0.39 | | | | |
| $C_4$ | 0.00 | 0.36 | | | | |
| $Y_5$ | 0.00 | 0.43 | 1.46 | 1.50 | ○ | ○ |
| $M_5$ | 0.037 | 0.38 | | | | |
| $C_5$ | 0.042 | 0.35 | | | | |
| $Y_6$ | 0.00 | 0.42 | 1.23 | 1.40 | ○ | ○ |
| $M_6$ | 0.056 | 0.35 | | | | |

TABLE 4-continued

| Dye Layer Ink | Content of MF8F (%) | $\mu_0$ | $\mu_1$ | $\mu_2$ | Printing property I | Printing property II |
|---|---|---|---|---|---|---|
| $C_6$ | 0.065 | 0.31 | | | | |

Printing Property I: (Influence on flexing of film during printing)
◎: Folding after printing was not occurred in the heat transfer sheet. The obtained image was excellent having no color drop-out.
○: There was a few minute folding after printing, but the obtained image was excellent having no color drop-out.
x: Many wrinkles were generated in the heat transfer sheet due to folding. Color drop-out occurred.
Printing Property II: (Influence on slip during printing)
○: Good image without color drop-out obtained.
x: During printing, positional slippage caused by slip between heat transfer sheet and image-receiving sheet occurred, and color slippage occurred in image obtained.

COMPARATIVE EXAMPLE C-1

A heat transfer sheet was obtained in the same manner as in Example C-1 except for using a polyethylene terephthalate film of 6 μm having a stretching degree in the MD direction increased to great extent as the substrate film. The evaluations are shown in the following Table 5.

TABLE 5

| Dye Layer Ink | Content of MF8F (%) | $\mu_0$ | $\mu_1$ | $\mu_2$ | Printing property I | Printing property II |
|---|---|---|---|---|---|---|
| $Y_7$ | 0 | 0.42 | 1.50 | 1.50 | X | ○ |
| $M_7$ | 0.021 | 0.40 | | | | |
| $C_7$ | 0.035 | 0.39 | | | | |
| $Y_8$ | 0 | 0.41 | 1.45 | 1.50 | X | ○ |
| $M_8$ | 0.030 | 0.39 | | | | |
| $C_8$ | 0.048 | 0.34 | | | | |
| $Y_9$ | 0.00 | 0.41 | 0.47 | 0.52 | ○ | X |
| $M_9$ | 0.37 | 0.20 | | | | |
| $C_9$ | 0.42 | 0.18 | | | | |

EXAMPLE C-2

A heat transfer sheet was obtained in the same manner as in Example C-1 except for using an acryl powder (XSA-300, Toa Gosei Kagaku Kogyo. K.K., Japan) as the additive. The evaluations are shown in the following Table 6.

TABLE 6

| Dye Layer Ink | Content of XSA-300 wt. (%) | $\mu_0$ | $\mu_1$ | $\mu_2$ | Printing property I | Printing property II |
|---|---|---|---|---|---|---|
| $Y_{10}$ | 0.46 | 0.35 | 0.81 | 1.23 | ◎ | ○ |
| $M_{10}$ | 0.34 | 0.33 | | | | |
| $C_{10}$ | 0.39 | 0.30 | | | | |
| $Y_{11}$ | 0.61 | 0.35 | 0.75 | 1.15 | ◎ | ○ |
| $M_{11}$ | 0.47 | 0.22 | | | | |
| $C_{11}$ | 0.52 | 0.24 | | | | |

EXAMPLE C-3

A heat transfer sheet was obtained in the same manner as in Example C-1 except for using a mixture of Microfine MF-8F and an acryl powder (XSA-300, Toa Gosei Kagaku Kogyo K.K., Japan) as the additive. The evaluations are shown in the following Table 7.

TABLE 7

| Dye Layer Ink | Content of MF-8F/XSA-300 | $\mu_0$ | $\mu_1$ | $\mu_2$ | Printing property I | Printing property II |
|---|---|---|---|---|---|---|
| $Y_{12}$ | 0.00%/0.46% | 0.34 | 0.73 | 1.09 | ◎ | ○ |
| $M_{12}$ | 0.87%/0.34% | 0.31 | | | | |

TABLE 7-continued

| Dye Layer Ink | Content of MF-8F/XSA-300 | $\mu_0$ | $\mu_1$ | $\mu_2$ | Printing property I | Printing property II |
|---|---|---|---|---|---|---|
| $C_{12}$ | 0.08%/0.39% | 0.28 | | | | |

We claim:

1. A heat transfer recording process which performs dotwise printing by means of a dotwise heating means, comprising the steps of:

providing (a) a heat transfer sheet comprising a lubricating layer provided on one surface of a substrate film and a dye layer comprising a sublimable dye and a binder, the dye layer being provided on the other surface of the substrate film, and (b) an image-receiving sheet comprising a substrate film and an image-receiving layer formed thereon, the dynamic frictional coefficient at non-printing between the dye layer of the heat transfer sheet and the image-receiving surface of the image-receiving sheet being within the range of from 0.1 to 0.6;

bringing the heat transfer layer of the heat transfer sheet into contact with the image-receiving layer of the image-receiving sheet; and carrying out dotwise printing in accordance with the image information.

2. The process of claim 1, in which the heat transfer sheet has dye layers of at least 3 colors, wherein (i) the dynamic frictional coefficient at non-printing ($\mu_0$) between the dye layer of a first color and the image-receiving surface of the image-receiving sheet is within the range of from 0.1 to 0.6, (ii) the dynamic frictional coefficient ($\mu_1$) between the image-receiving surface after solid printing of the first color and a second color dye layer is within the range of from 0.3 to 1.0, and (iii) the dynamic frictional coefficient ($\mu_2$) between the image-receiving surface after solid printing with the second color dye layer overlapped on the solid printing of the first color and a third color dye layer is within the range of from 0.6 to 1.5.

3. The process of claim 1, wherein the dotwise heating means is a thermal head.

4. The process of claim 1, wherein the lubricating layer of the heat transfer sheet has heat-resisting property.

5. The process of claim 1, wherein the heat transfer sheet contains an antistatic agent in at least one layer of the dye layer, substrate film and lubricating layer.

6. A heat transfer recording process which performs dotwise printing by means of a dotwise heating means, comprising the steps of:

providing (a) a heat transfer sheet comprising a lubricating layer provided on one surface of a substrate film and a dye layer comprising a sublimable dye and a binder, the dye layer being provided on the other surface of the substrate film, and (b) and image-receiving sheet comprising a substrate film and an image-receiving layer formed thereon, the elastic modulus in at least one of the sub-scanning direction (MD) and the main scanning direction (TD) in the heat transfer sheet is 280 kg/mm$^2$ or more, and the elastic modulus ratio MD/TD in the sub-scanning direction (MD) and the main scanning direction (TD) is within the range of from 0.8 to 1.3;

bringing the heat transfer layer of the heat transfer sheet into contact with the image-receiving layer of the image-receiving sheet; and carrying out dotwise printing in accordance with the image information.

7. The process of claim 6, wherein the heating shrinkages in the sub-scanning direction (MD) and the main scanning direction (TD) are 0 to 2.5% under the conditions of 150° C. and 30 minutes.

8. The process of claim 6, wherein the lubricating layer of the heat transfer sheet has heat-resisting property.

9. The process of claim 6, wherein the heat transfer sheet contains an antistatic agent in at least one layer of the dye layer, substrate film and lubricating layer.

10. A heat transfer recording process which performs dotwise printing by means of a thermal head, comprising the steps of:

providing (a) a heat transfer sheet comprising a lubricating layer provided on one surface of a substrate film and a dye layer comprising a sublimable dye and a binder, the dye layer being provided on the other surface of the substrate film, and (b) an image-receiving sheet comprising a substrate film and an image-receiving layer formed thereon, the dynamic frictional coefficient between the lubricating layer and the thermal head being within the range of from 0.07 to 0.16;

bringing the heat transfer layer of the heat transfer sheet into contact with the image-receiving layer of the image-receiving sheet; and carrying out dotwise printing in accordance with the image information.

11. The process of claim 10, wherein the lubricating layer of the heat transfer sheet has heat-resisting property.

12. The process of claim 10, wherein the heat transfer sheet contains an antistatic agent in at least one layer of the dye layer, substrate film and lubricating layer.

* * * * *